US006695500B2

(12) United States Patent
Kim et al.

(10) Patent No.: US 6,695,500 B2
(45) Date of Patent: Feb. 24, 2004

(54) PAPER HOLDING DEVICE FOR LABEL PRINTER

(75) Inventors: Jin-Gwan Kim, Suwon-si (KR); Jang-Hwan Kim, Suwon-si (KR)

(73) Assignee: Samsung Electro-Mechanics Co., Ltd., Kyunggi-do (KR)

( * ) Notice: Subject to any disclaimer, the term of this patent is extended or adjusted under 35 U.S.C. 154(b) by 0 days.

(21) Appl. No.: 10/151,171

(22) Filed: May 21, 2002

(65) Prior Publication Data

US 2003/0170065 A1 Sep. 11, 2003

(30) Foreign Application Priority Data

Mar. 8, 2002 (KR) ..... 2002-12485

(51) Int. Cl.[7] ..... B65H 16/06; B41J 15/02; B41J 15/04

(52) U.S. Cl. ..... 400/613; 400/611; 400/120.16; 242/578; 242/578.2; 242/596.7; 242/596.8

(58) Field of Search ..... 242/578.2, 578, 242/596, 596.1, 596.7, 596.8; 400/611, 613, 120.16

(56) References Cited

U.S. PATENT DOCUMENTS 5,486,259 A * 1/1996 Goodwin et al. ..... 156/384
5,813,343 A * 9/1998 Harb ..... 101/407.1
6,431,492 B1 * 8/2002 Chillscyzn ..... 242/577
6,503,008 B2 * 1/2003 Zevin et al. ..... 400/613

FOREIGN PATENT DOCUMENTS

JP 62083958 A * 4/1987 ..... B65H/16/06

* cited by examiner

*Primary Examiner*—Daniel J. Colilla
(74) *Attorney, Agent, or Firm*—Morgan, Lewis & Bockius LLP

(57) ABSTRACT

Disclosed is a paper holding device for a label printer. The paper holding device comprises left and right holders for supporting both ends, respectively, of a paper roll; left and right guide links respectively locked to lower ends of the left and right holders; a rotation link for operatively connecting the left and right guide links with each other and moving them in leftward and rightward directions; a bottom panel secured with respect to a floor of a printer body, for rotatably installing thereon the rotation link; and a pair of elastic members having one ends connected to the left and right guide links and the other ends connected to the bottom panel, to apply elastic force to the left and right guide links.

17 Claims, 7 Drawing Sheets

PAPER HOLDING DEVICE FOR LABEL PRINTER

BACKGROUND OF THE INVENTION

1. Field of the Invention

The present invention relates to a paper holding device used for holding a paper roll of a varying size accommodated in a label printer, more particularly, to a paper holding device for a label printer, which is modified in its construction to allow a paper roll to be easily and quickly mounted thereon and avoid malfunction of component elements thereof.

2. Description of the Related Art

Generally, a label printer is used to print a trade name, a price, an expiration date, etc. on a label sheet and thereby allow the printed label sheet to be affixed to a product. A number of label sheets are peelably attached to paper which is wound in the form of a roll, in a manner such that they are spaced apart one from another by a certain distance. Depending upon a use, the paper has a width of about 1 to 4 inches.

The paper which is wound in the form of a roll is accommodated in a body of the label printer. The paper roll is rotatably supported in its center hole by a holding device. Consequently, the paper can be continuously paid out from the roll as a printing work proceeds. The paper is fed between a printing roller and a printing head which constitute a printing section, by a feeding roller, to allow the label sheets to be properly printed.

Referring to FIG. 1, there is illustrated a conventional label printer. The label printer has a printer body 3 and a cover 1 which is hingedly coupled to a rear end of the printer body 3. A printing head 2 is installed on a lower surface of a distal end of the cover 1. An accommodating section 4 for accommodating paper P wound in the form of a roll is defined in the printer body 3. A paper guide device for guiding both widthwise edges of the paper P is disposed in front of the accommodating section 4. Further, a printing roller 5 is arranged in front of the paper guide device to be brought into contact with the printing head 2. The printing roller 5 functions to support each label sheet attached to the paper P, upon printing. The paper roll P is held in place by a paper holding device.

Referring to FIG. 2, the conventional paper holding device employed in the label printer includes left and right holders 10 and 20, left and right guide links 30 and 40, a bottom panel 60, a pinion gear 70, a pair of tension springs S, and a fastening screw 80. The left and right holders 10 and 20 respectively have circular protrusions 11 and 21 which are formed at upper ends of the left and right holders 10 and 20 to be inserted into both ends of a center hole P1 of the paper roll P thereby to support the paper roll P, grips 12 and 22 which are formed adjacent to lower ends of the left and right holders 10 and 20, and bases 13 and 23 which are formed at the lower ends of the left and right holders 10 and 20. Each of the bases 13 and 23 is integrally formed, at front and rears ends thereof, with a pair of leg portions. Grooves 13*a* and 23*a* are defined on lower surfaces of the leg portions of the bases 13 and 23. Two pairs of first locking holes 13*b* and 23*b* are defined through the rear leg portion of the left base 13 and the front leg portion of right base 23 in such a way as to extend in a vertical direction and be communicated with the grooves 13*a* and 23*a*, respectively. A first threaded hole 23*c* is defined through the rear leg portion of the right base 23 to extend in the vertical direction. The left and right guide links 30 and 40 respectively have guide projections 31 and 41 to be received in the grooves 13*a* and 23*a* of the left and right holders 10 and 20, guide plates 32 and 42 which are integrally secured to lower ends of the guide projections 31 and 41 and formed, on their respective front and rear surfaces, with rack gears 34 and 44, and hook pieces 33 and 43 which are fastened to respective rear and front surfaces of the guide plates 32 and 42. The guide projections 31 and 41 are defined with two pairs of second locking holes 31*a* and 41*a* which are respectively aligned with the two pairs of first locking holes 13*b* and 23*b*. A pair of locking screws A are driven into the first locking holes 13*b* and 23*b* and the second locking holes 31*a* and 41*a* to lock the left and right holders 10 and 20 to the left and right guide links 30 and 40, respectively. The bottom panel 60 is defined with a pair of guide slots 61 and 62 for guiding leftward and rightward movement of the left and right guide links 30 and 40, and has a shaft portion 63 which is formed on a lower surface of the bottom panel 60 between the pair of guide slots 61 and 62 to project downward. As can be readily seen from FIG. 2, the bottom panel 60 further has a plurality of second threaded holes 64 which are defined through the bottom panel 60 over the same width as the right guide slot 62 of the bottom panel 60. The bottom panel 60 is secured with respect to a floor of the printer body 3. The pinion gear 70 is rotatably fitted around the shaft portion 63 of the bottom panel 60 to be meshed with the rack gears 34 and 44 of the guide plates 32 and 42 of the left and right guide links 30 and 40. The pair of tension springs S have one ends which are connected to the hook pieces 33 and 43 of the left and right guide links 30 and 40 and the other ends which are connected to the bottom panel 60. The tension springs S apply elastic pulling force to the left and right guide links 30 and 40. The fastening screw 80 is driven into the first threaded hole 23*c* and one of the plurality of second threaded holes 64 to fix the right holder 20 to the bottom panel 60.

That is to say, the fastening screw 80 functions to fixedly hold the left and right holders 10 and 20 with respect to the bottom panel 60. By this fact, it is possible to primarily guide both widthwise edges of a separate paper sheet (not shown) which has peelably attached thereto label sheets and is manually fed forward from the rear end of the printer body 3, between the left and right holders 10 and 20 which are properly adjusted in spacing.

Hereafter, operation of the conventional paper holding device for a label printer, constructed as mentioned above, will be described.

Referring to FIGS. 2 and 3, when it is necessary to mount the paper roll P which has a width of about 1 to 4 inches depending upon a use, the paper roll P is first accommodated in the accommodating section 4 which is defined in the printer body 3. Next, the grips 12 and 22 of the left and right holders 10 and 20, which are respectively located at both widthwise ends of the accommodating section 4, are grasped by the hands, and then respectively moved away from each other to define a spacing greater than a width of the paper roll P.

The guide projections 31 and 41 of the left and right guide links 30 and 40 are respectively received in the grooves 13*a* and 23*a* which are defined on the lower surfaces of the rear leg portion of the left base 13 and the front leg portion of right base 23. Then, by driving the locking screws A into the first locking holes 13*b* and 23*b* of the bases 13 and 23 and the second locking holes 31*a* and 41*a* of the guide projections 31 and 41, the bases 13 and 23 and the guide projections 31 and 41 are rigidly coupled with each other, respectively. As a consequence, the left and right holders 10 and 20 and the left and right guide links 30 and 40 can be integrally moved along the guide slots 61 and 62 of the bottom panel 60 in a horizontal direction. If the grips 12 and 22 of the left and right holders 10 and 20 are released, the protrusions 11 and 21 of the left and right holders 10 and 20 are respectively inserted into both ends of the center hole P1 of the paper roll P to support the paper roll P.

Due to the fact that the rack gears 34 and 44 of the guide plates 32 and 42 of the left and right guide links 30 and 40, which can be simultaneously actuated by the medium of the respective left and right holders 10 and 20, are meshed with the pinion gear 70 which is rotatably fitted around the shaft portion 63 projectedly formed on the lower surface of the bottom panel 60, a first combination of the left holder 10 and the left guide link 30 and a second combination of the right holder 20 and the right guide link 40 can be simultaneously moved inward or outward, that is, toward or away from each other. The pair of tension springs S which are connected at both ends thereof to the hook pieces 33 and 43 of the left and right guide links 30 and 40 and the bottom panel 60, apply elastic pulling force to the left and right guide links 30 and 40. Therefore, the protrusions 11 and 21 of the left and right holders 10 and 20 are biased by the pair of tension springs S to be inserted into both ends of the center hole P1 of the paper roll P.

In the state wherein the protrusions 11 and 21 of the left and right holders 10 and 20 are spring-biasedly inserted into both ends of the center hole P1 of the paper roll P, each label sheet attached to the paper P can be printed by the printing head 2 while being fed forward by the feeding roller.

In the meanwhile, in the case that, instead of using the roll type paper P, a separate paper sheet is manually fed forward from the rear end of the printer body 3, the left and right holders 10 and 20, which are properly adjusted in spacing therebetween, function to primarily guide both widthwise edges of the separate paper sheet. To this end, as can be readily seen from FIG. 3, the fastening screw 80 is driven into the first threaded hole 23*c* which is defined through the rear leg portion of the right base 23 of the right holder 20 and one of the plurality of second threaded holes 64 which are defined through the bottom panel 60, whereby the left and right holders 10 and 20 are fixedly held with respect to the bottom panel 60 to stably guide both widthwise edges of the separate paper sheet.

The conventional paper holding device for holding the paper roll P as described above suffers from defects in that, since the left and right holders 10 and 20 are moved toward or away from each other in the horizontal direction through meshing engagement between the rack gears of the guide plates 32 and 42 of the left and right guide links 30 and 40 and the pinion gear 70, a time required for adjusting a spacing between the left and right holders 10 and 20 is relatively lengthened. Also, in order to mount the paper roll P on the left and right holders 10 and 20, it is necessary to unthread the fastening screw 80 from the bottom panel 60 thereby to allow the left and right guide links 30 and 40 rigidly coupled to the left and right holders 10 and 20 to be moved on the pinion gear 70 and a spacing between the left and right holders 10 and 20 to be freely adjusted, and thereby inconvenience is caused.

Further, upon fixing the holder 20 to the bottom panel 60 using the fastening screw 80, the likelihood of the fastening screw 80 to be lost in the printer body 3 is increased. In this regard, since the fastening screw 80 must be held driven to some extent into the first threaded hole 23*c* of right holder 20 while the separate paper sheet is manually fed forward between the left and right holders 10 and 20, cumbersomeness is provoked.

Moreover, because a driver is necessarily needed to drive or remove the fastening screw 80 into or from the one of the plurality of second threaded holes 64 upon mounting the paper roll P on the left and right holders 10 and 20 or guiding the separate paper sheet between the fixed left and right holders 10 and 20, a paper roll mounting or separate paper sheet guiding procedure cannot but be retarded. Besides, as the fastening screw 80 is driven into or removed from the second threaded hole 64 a multitude of times, threaded portions of the fastening screw 80 and the second threaded hole 64 are apt to be crushed, whereby uneconomy may result in.

Furthermore, since the left and right guide links 30 and 40 must be repeatedly moved outward or inward, that is, toward or away from each other, with the rack gears 34 and 44 of the guide plates 32 and 42 meshed with the pinion gear 70, to adjust a spacing between the left and right holders 10 and 20, the rack gears and the pinion gear 70 are likely to be broken down. In addition, as the rack gears 34 and 44 and the pinion gear 70 are injection-molded, manufacturing costs cannot but be increased due to design and fabrication of respective molds.

SUMMARY OF THE INVENTION

Accordingly, the present invention has been made in an effort to solve the problems occurring in the related art, and an object of the present invention is to provide a paper holding device used for holding a paper roll of a varying size accommodated in a label printer, which is modified in its construction to allow the paper roll to be easily and quickly mounted thereon and left and right holders to be easily and guickly fixed to or freed from a bottom panel upon primarily guiding both widthwise edges of a manually fed separate paper sheet.

In order to achieve the above object, according to one aspect of the present invention, there is provided a paper holding device for a label printer, comprising: left and right holders for supporting both ends, respectively, of a paper roll; left and right guide links respectively locked to lower ends of the left and right holders; a rotation link for operatively connecting the left and right guide links with each other and moving them in leftward and rightward directions; a bottom panel secured with respect to a floor of a printer body, for rotatably installing thereon the rotation link; and a pair of elastic members having one ends connected to the left and right guide links and the other ends connected to the bottom panel, to apply elastic force to the left and right guide links.

According to another aspect of the present invention, there is provided a paper holding device for a label printer, comprising: left and right holders for supporting both ends, respectively, of a paper roll; left and right guide links respectively locked to lower ends of the left and right holders; a rotation link for operatively connecting the left and right guide links with each other and moving them in leftward and rightward directions; a bottom panel secured with respect to a floor of a printer body, for rotatably installing thereon the rotation link which functions to guide leftward and rightward movement of the left and right guide links; and an elastic member connected to the rotation link to apply elastic force to the rotation link as the rotation link is rotated.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
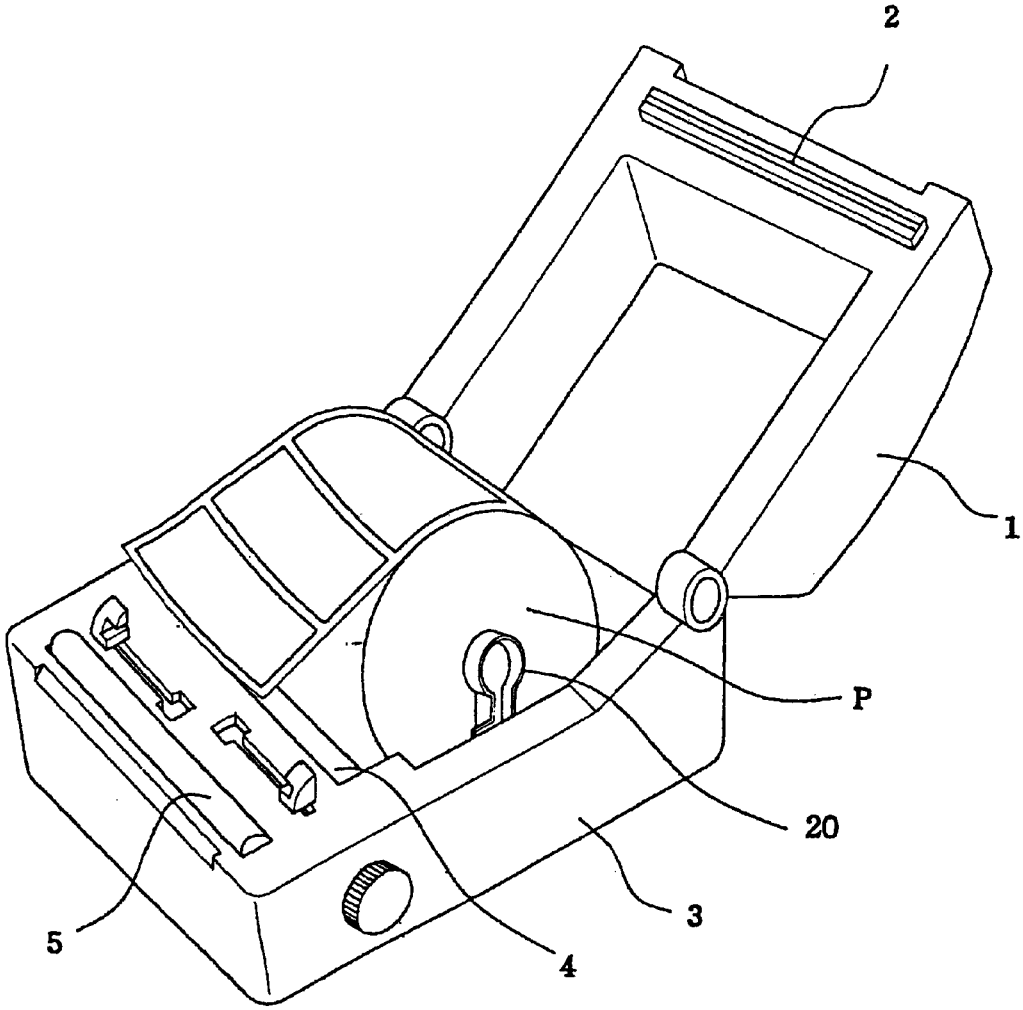
FIG. 1 PRIOR ART
FIG. 1 is a perspective view illustrating a conventional label printer.
Figure 2:
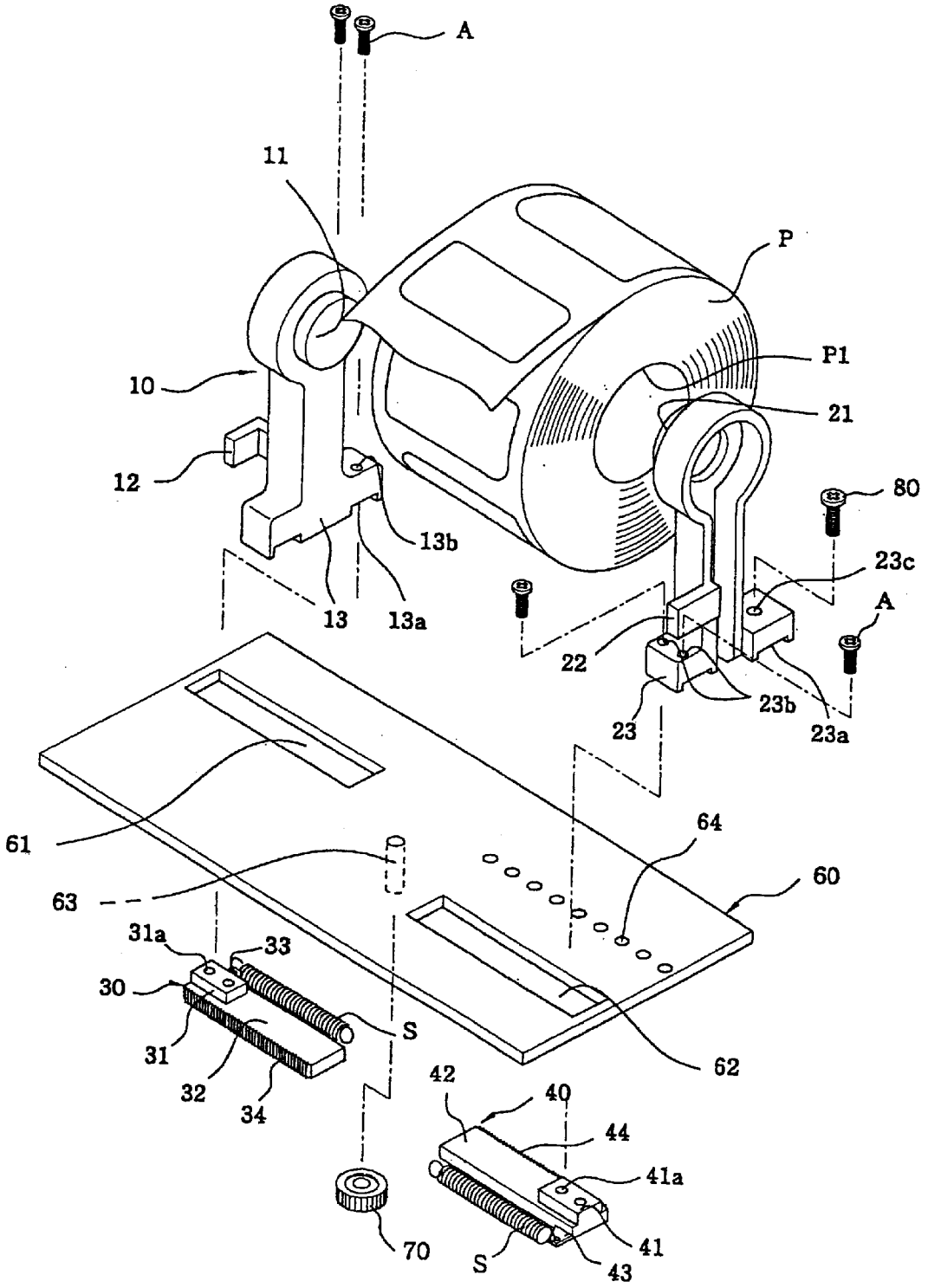
FIG. 2 PRIOR ART
FIG. 2 is an exploded perspective view illustrating a conventional paper holding device for a label printer.
Figure 3:
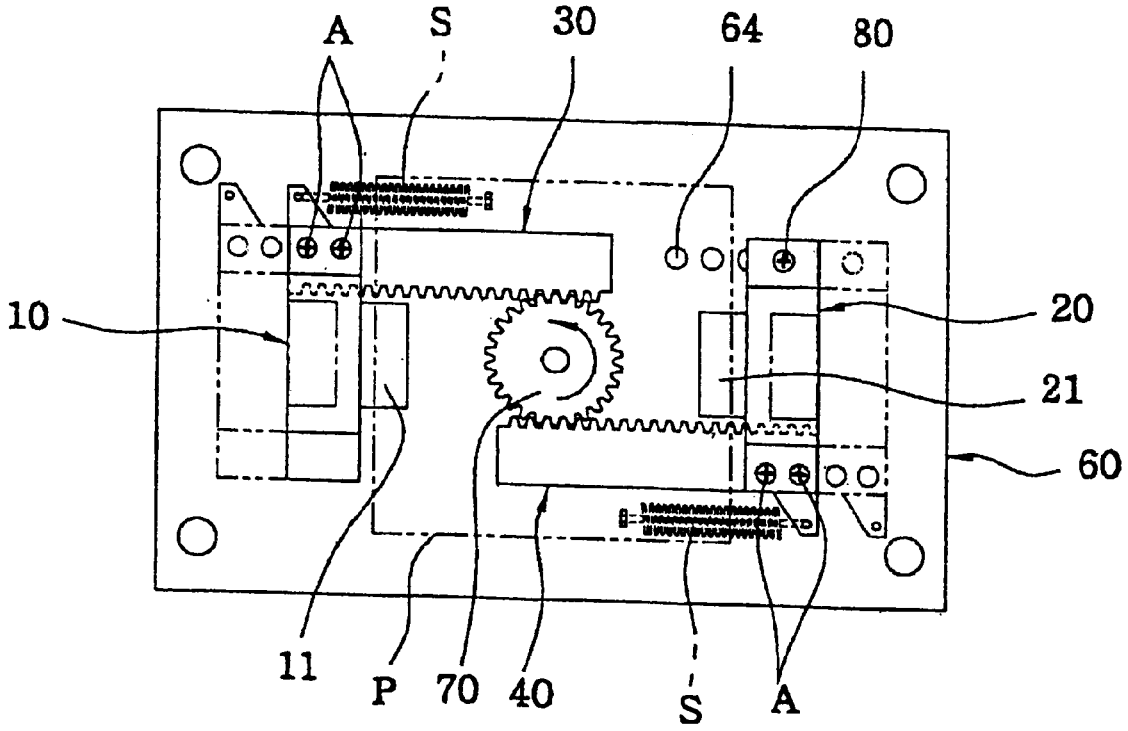
FIG. 3 PRIOR ART
FIG. 3 is a plan view illustrating a state wherein the paper holding device of FIG. 2 is assembled and used.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 4:
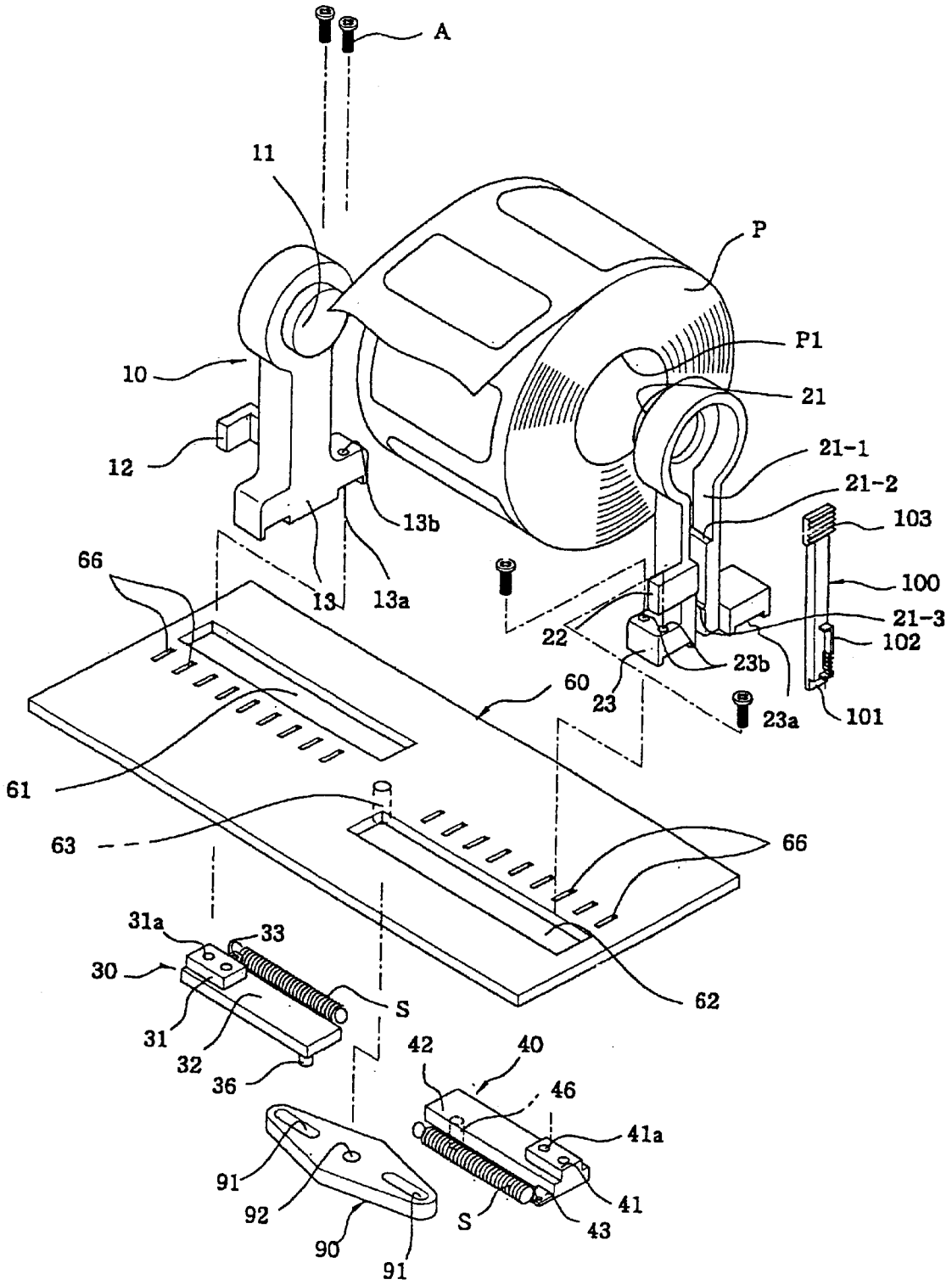
FIG. 4 is an exploded perspective view illustrating a paper holding device for a label printer in accordance with a first embodiment of the present invention.
Figure 5:
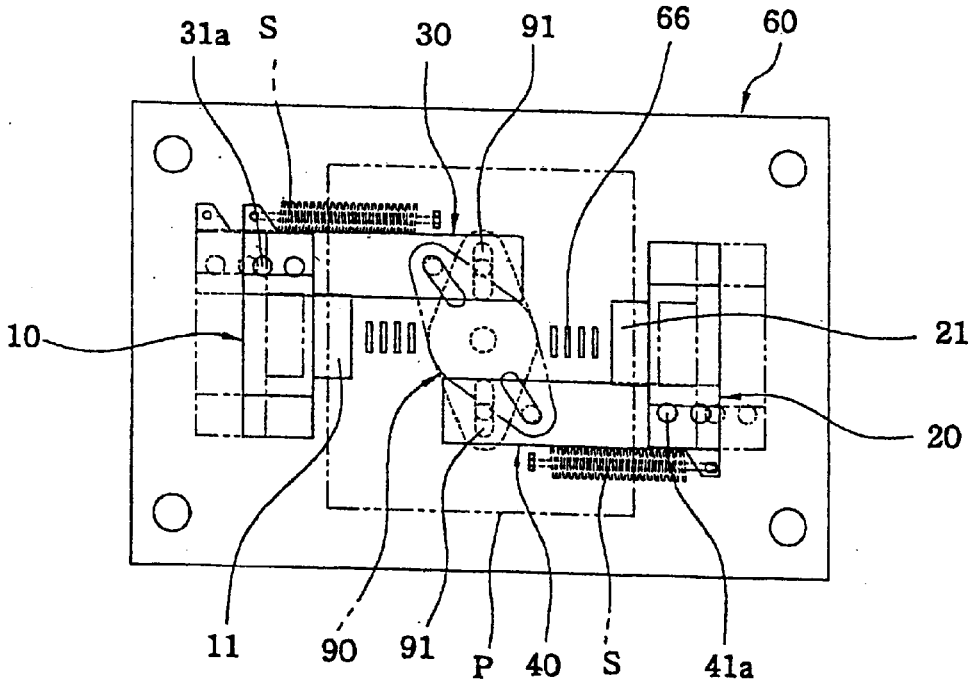
FIG. 5 is a plan view illustrating a state wherein the paper holding device of FIG. 4 is assembled and used.
Figure 6:
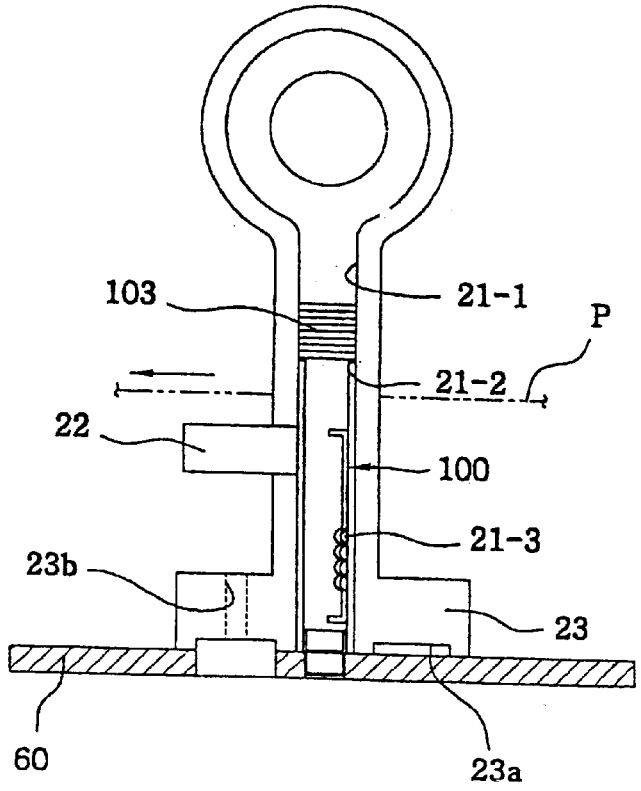
FIG. 6 is a side view illustrating a lever hook used for fixing a holder in the paper holding device according to the present invention.

FIG. 4 is an exploded perspective view illustrating a paper holding device for a label printer in accordance with a first embodiment of the present invention; FIG. 5 is a plan view illustrating a state wherein the paper holding device of FIG. 4 is assembled and used; and FIG. 6 is a side view illustrating a lever hook used for fixing a holder in the paper holding device according to the present invention.

As in the conventional art, a label printer of the present invention comprises an upper cover 1, a printer body 3 and paper guide means. As shown in FIG. 1, the cover 1 is hingedly coupled to a rear end of the printer body 3. A printing head 2 is installed on a lower surface of a distal end of the cover 1. An accommodating section 4 for accommodating paper P wound in the form of a roll is defined in the printer body 3. The paper guide means for guiding both widthwise edges of the paper P is disposed in front of the accommodating section 4. Further, a printing roller 5 is arranged in front of the paper guide means to be brought into contact with the printing head 2. The printing roller 5 functions to support each label sheet attached to the paper P, upon printing.

Referring to FIG. 5, a paper holding device for a label printer in accordance with a first embodiment of the present invention includes left and right holders 10 and 20 for supporting both ends, respectively, of the paper roll P. The left and right holders 10 and 20 respectively comprise circular protrusions 11 and 21, grips 12 and 22, and bases 13 and 23. The circular protrusions 11 and 21 are formed at upper ends of the left and right holders 10 and 20 to be inserted into both ends of a center hole P1 of the paper roll P thereby to support the paper roll P. The grips 12 and 22 are projectedly formed adjacent to the lower ends of the left and right holders 10 and 20. The bases 13 and 23 are formed at the lower ends of the left and right holders 10 and 20. Each of the bases 13 and 23 is provided, at front and rears ends thereof, with a pair of leg portions, and defined, on lower surfaces of the leg portions, with grooves 13*a* and 23*a*. The rear leg portion of the left base 13 and the front leg portion of right base 23 are defined with two pairs of first locking holes 13*b* and 23*b* which extend in a vertical direction and are communicated with the grooves 13*a* and 23*a*, respectively. Vertical guide grooves 21-1 are defined on surfaces of the left and right holders 10 and 20, which surfaces are opposite to the circular protrusions 11 and 21. Stepped portions 21-2 are formed at a predetermined location on the surfaces of the left and right holders 10 and 20, defining the vertical guide grooves 21-1. Engagement projections 21-3 are formed below the stepped portions 21-2 on the surfaces of the left and right holders 10 and 20, defining the vertical guide grooves 21-1.

Left and right guide links 30 and 40 are respectively locked to the lower ends of the left and right holders 10 and 20 in a manner such that they can be moved inward or outward, that is, toward or away from each other, in a horizontal direction.

The left and right guide links 30 and 40 respectively comprise guide projections 31 and 41, guide plates 32 and 42, hook pieces 33 and 43, and pin portions 36 and 46. The guide projections 31 and 41 are received in the grooves 13*a* and 23*a* of the left and right holders 10 and 20, and defined with two pairs of second locking holes 31*a* and 41*a* which are respectively aligned with the two pairs of first locking holes 13*b* and 23*b*. The guide plates 32 and 42 are secured to the guide projections 31 and 41. The hook pieces 33 and 43 are fastened to respective rear and front surfaces of the guide plates 32 and 42. The pin portions 36 and 46 are projectedly formed on lower surfaces of the guide plates 32 and 42 in a manner such that they are opposite to the guide projections 31 and 41.

The left and right guide links 30 and 40 are operatively connected with each other by a rotation link 90 to be simultaneously moved in leftward and rightward directions. The rotation link 90 is defined with a pair of elongate holes 91 for guiding the pin portions 36 and 46 of the left and right guide links 30 and 40. The rotation link 90 is also defined, between the pair of elongate holes 91, with an insertion hole 92.

The left and right guide links 30 and 40 are operatively joined to a bottom panel 60 which is secured with respect to a floor of the printer body 3.

The bottom panel 60 comprises a pair of guide slots 61 and 62, a shaft portion 63, and a plurality of spacing adjustment perforations 66. The pair of guide slots 61 and 62 serve to guide leftward and rightward movement of the left and right guide links 30 and 40. The shaft portion 63 is projectedly formed on a lower surface of the bottom panel 60 between the pair of guide slots 61 and 62 to be rotatably fitted into the insertion hole 92 of the rotation link 90. The plurality of spacing adjustment perforations 66 are defined through the bottom panel 60 adjacent to the pair of guide slots 61 and 62 to be arranged in line along a widthwise direction of the paper roll P.

In order to ensure that a spacing between the left and right holders 10 and 20 which can primarily guide both widthwise edges of a separate paper sheet manually fed forward from a rear end of the printer body 3 is properly adjusted through the plurality of spacing adjustment perforations 66 of the bottom panel 60, one lever hook 100 is installed on selected one of the left and right holders 10 and 20. The lever hook 100 comprises a fixing key portion 101, an engagement piece 102, and a grasping portion 103. The fixing key portion 101 is formed at a lower end of the lever hook 100 to be removably fitted into one of the plurality of spacing adjustment perforations 66. The engagement piece 102 is projectedly secured adjacent to the lower end of the lever hook 100 to be engaged with the engagement projection 21-3 of the corresponding holder 10 or 20. The grasping portion 103 is integrally formed at an upper end of the lever hook 100 in a manner such that it can be rested on the stepped portion 21-2 of the corresponding holder 10 or 20.

It is preferred that at least two engaging grooves are defined on the engagement piece 102 of the lever hook 100 to allow the engagement projection 21-3 of the corresponding holder 10 or 20 to be engaged in the engaging grooves in a stepwise manner. The fixing key portion 101 of the lever hook 100 and each of the spacing adjustment perforations 66 of the bottom panel 60 are formed and defined to have an elongate contour.

It is to be noted that one hook lever 100 may be installed on selected one of the left and right holders 10 and 20, or two hook levers 100 may be installed on both of the left and right holders 10 and 20.

Meanwhile, one ends of a pair of elastic members S are connected to the hook pieces 33 and 43 of the left and right guide links 30 and 40, and the other ends of the pair of elastic members S are connected to the bottom panel 60, to apply elastic force to the left and right guide links 30 and 40.

The elastic members S may comprise coiled tension springs which are connected at one ends thereof to the left and right guide links 30 and 40 and at the other ends thereof to the bottom panel 60.

Figure 7:
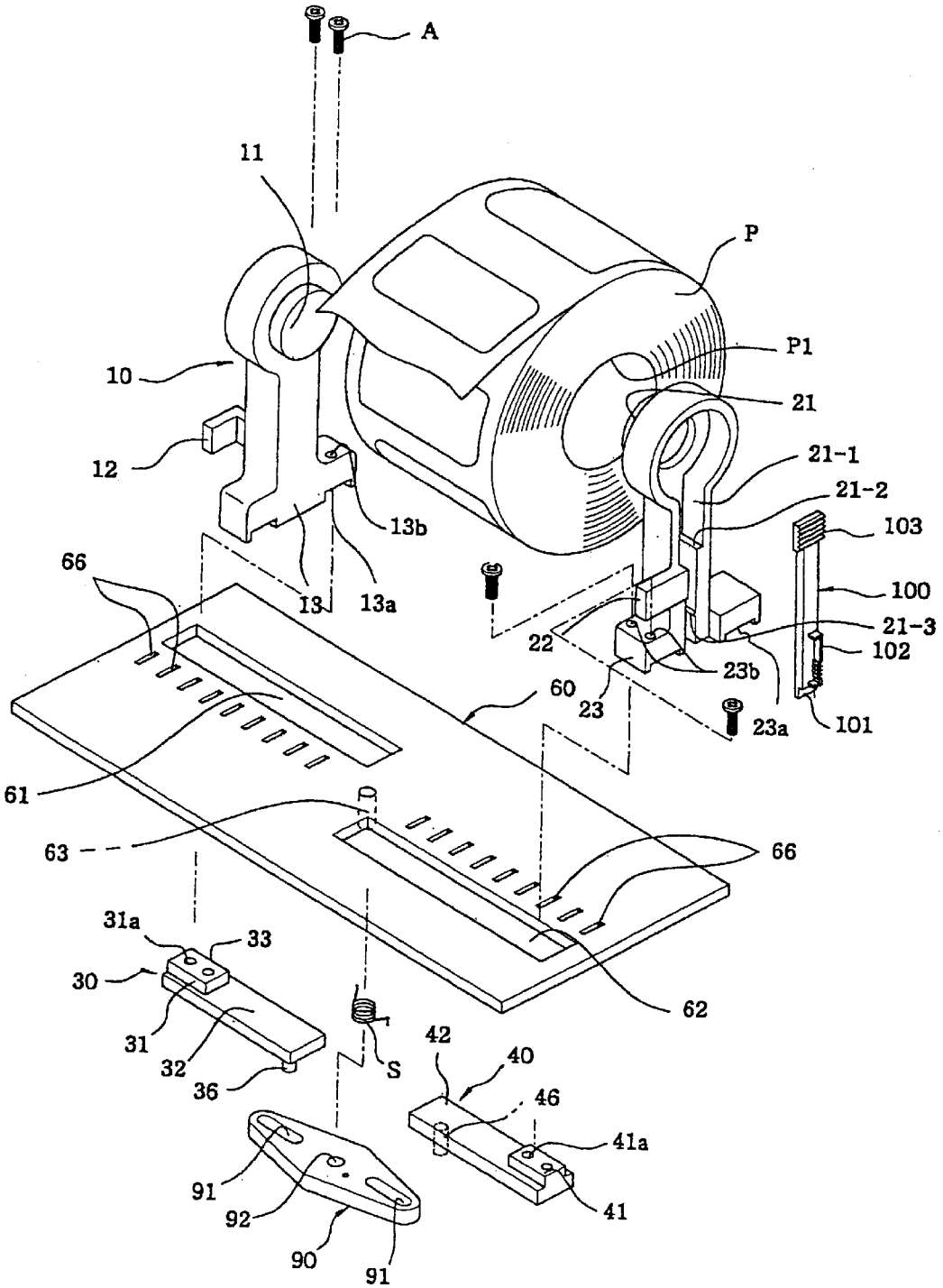
FIG. 7 is an exploded perspective view illustrating a paper holding device for a label printer in accordance with a second embodiment of the present invention.
Figure 8:
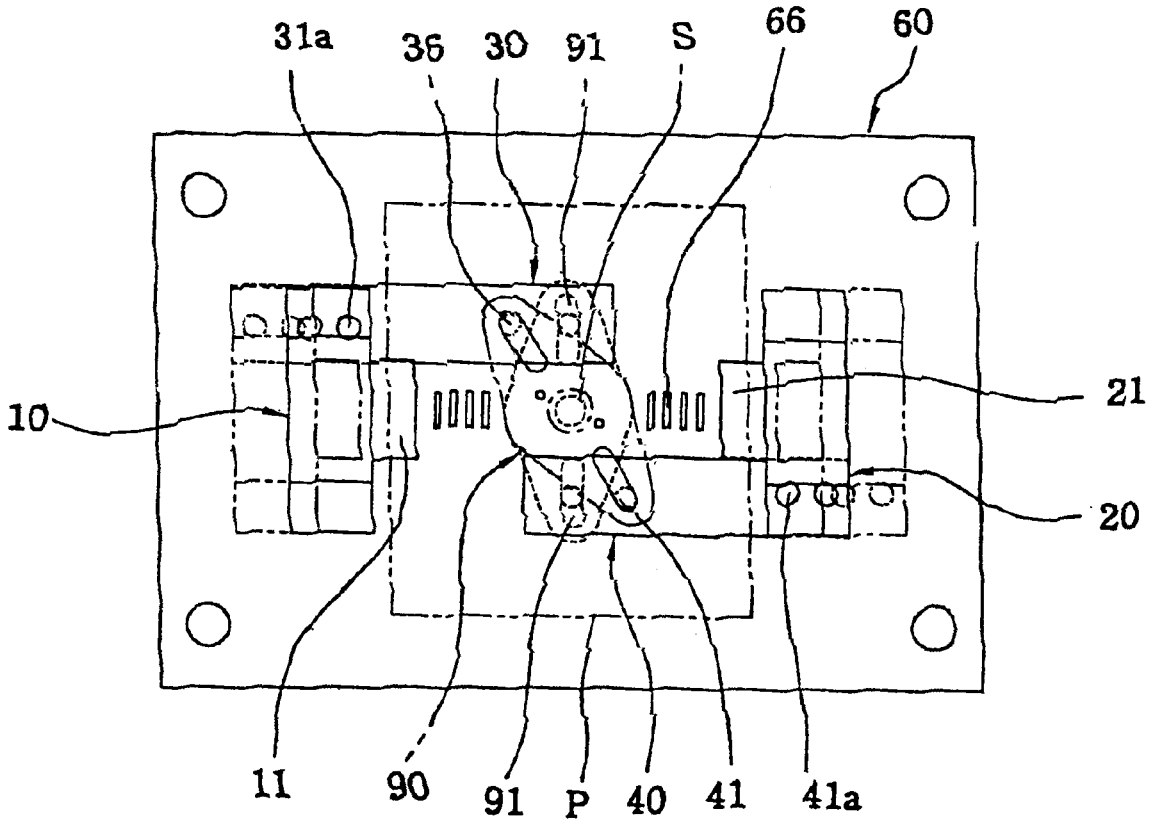
FIG. 8 is a plan view illustrating a state wherein the paper holding device of FIG. 7 is assembled and used.

FIG. 7 is an exploded perspective view illustrating a paper holding device for a label printer in accordance with a second embodiment of the present invention; and FIG. 8 is a plan view illustrating a state wherein the paper holding device of FIG. 7 is assembled and used. The paper holding device according to this second embodiment of the present invention comprises left and right holders 10 and 20, left and right guide links 30 and 40, a rotation link 90, a lever hook 100, and an elastic member S which is installed between the floor of the printer body 3 and the rotation link 90. The elastic member S comprises a torsion spring.

Hereafter, operation of the paper holding device for a label printer according to the present invention, constructed as mentioned above, will be described.

Upon initially mounting a paper roll of a desired width on the paper holding device or replacing a currently used paper roll with new one of a different width, as the paper roll P to be mounted is accommodated in the accommodating section 4 defined in the printer body 3, the grips 12 and 22 of the left and right holders 10 and 20 serving as component elements of the paper holding device, which are respectively located at both widthwise ends of the accommodating section 4, are grasped by the hands, and then respectively moved away from each other to define a spacing measured between the left and right holders 10 and 20, which is greater than the width of the paper roll P.

The guide projections 31 and 41 of the left and right guide links 30 and 40 are respectively received in the grooves 13*a* and 23*a* which are defined on the lower surfaces of the rear leg portion of the left base 13 and the front leg portion of right base 23. Then, by driving the locking screws A into the first locking holes 13*b* and 23*b* of the bases 13 and 23 and the second locking holes 31*a* and 41*a* of the guide projections 31 and 41, the bases 13 and 23 and the guide projections 31 and 41 are rigidly coupled with each other, respectively. As a consequence, the left and right holders 10 and 20 and the left and right guide links 30 and 40 can be integrally moved along the pair of guide slots 61 and 62 of the bottom panel 60 in a horizontal direction. If the grips 12 and 22 of the left and right holders 10 and 20 are released, the protrusions 11 and 21 of the left and right holders 10 and 20 are respectively inserted into both ends of the center hole P1 of the paper roll P to support the paper roll P.

The left and right guide links 30 and 40, which are integrally moved with the left and right holders 10 and 20, are simultaneously actuated by the rotation link 90 since they are operatively connected with each other by the rotation link 90. Due to the fact that the shaft portion 63 of the bottom panel 60 is rotatably fitted into the insertion hole 92 of the rotation link 90, the rotation link 90 can be rotated about the shaft portion 63 of the bottom panel 60. At this time, as can be readily seen from FIG. 5, as the pin portions 36 and 46 projectedly formed on the lower surfaces of the guide plates of the left and right guide links 30 and 40 are respectively moved along the pair of elongate holes 91, a spacing between the left and right holders 10 and 20 which are moved inward or outward can be narrowed or widened.

Thus, when compared to the conventional paper holding device in which the rack gears of the guide plates of the left and right guide links are meshed with the pinion gear, in the present invention, leftward and rightward movement of the left and right guide links 30 and 40 can be implemented in a short period of time, and thereby, spacing adjustment can be easily and quickly executed.

While the left and right guide links 30 and 40 are simultaneously moved inward or outward by the rotation link 90, since the elastic members S are connected to the hook pieces 33 and 43 of the left and right guide links 30 and 40 and the bottom panel 60, elastic pulling force is applied to the left and right guide links 30 and 40. By this fact, the left and right holders 10 and 20 are biased to be respectively inserted into both ends of the center hole P1 of the paper roll P thereby to stably support the paper roll P.

In the meanwhile, referring to FIGS. 6 and 7, it is to be readily recognized that, by manipulating the lever hook 100 which is disposed in the vertical guide groove 21-1 of selected one of the left and right holders 10 and 20 (in this preferred embodiment, the right holder 20) to extend in the vertical direction, the fixing key portion 101, which is formed at the lower end of the lever hook 100, can be fitted into one of the plurality of spacing adjustment perforations 66 defined through the bottom panel 60, and in this way, a spacing between the left and right holders 10 and 20 can be effectively adjusted.

In other words, the lever hook 100 is manipulated in a manner such that, by grasping and pressing downward the grasping portion 103 integrally formed at the upper end of the lever hook 100, the engagement piece 102 projectedly secured adjacent to the lower end of the lever hook 100 is forcibly moved downward while riding on the engagement projection 21-3 formed on the surface of the corresponding holder 20, and after passing through the lower end of the right holder 20, is fitted into one of the plurality of spacing adjustment perforations 66. As the grasping portion 103 of the lever hook 100 is grasped and pressed downward, the grasping portion 103 is finally rested on the stepped portion 21-2 formed on the surface of the right holder 20, defining the vertical guide groove 21-1, to be prevented from being further moved downward, and the fixing key portion 101 of the hook lever 100 is fitted into one of the plurality of spacing adjustment perforations 66.

Each spacing adjustment perforation 66 has a rectangular elongate contour, and in conformity with this, the fixing key portion 101 of the lever hook 100 is formed to have a slim and long contour. By these facts, the spacing adjustment perforations 66 of the bottom panel 60 can be defined to have a narrow interval, whereby precise adjustment of a spacing between the left and right holders 10 and 20 is enabled.

As a result, in a state wherein a spacing between the left and right holders 10 and 20 is properly adjusted on the bottom panel 60, both widthwise edges of the separate paper sheet, which is manually fed forward from the rear end of the printer body 3, can be primarily guided by the left and right holders 10 and 20. Thereafter, the separate paper sheet is secondarily guided by the paper guide means which is disposed in front of the accommodating section 4 of the printer body 3.

In other words, by simply manipulating the lever hook 100 in a manner such that the fixing key portion 101 is fitted into one of the plurality of spacing adjustment perforations 66 of the bottom panel 60, the separate paper sheet manually fed forward can be primarily guided. Normally, all of the left and right holders 10 and 20 are held unfixed to the bottom panel 60. In this state, the left and right holders 10 and 20, which are coupled with the left and right guide links 30 and 40 operatively connected with each other by the rotation link 90, can be moved toward or away from each other to be adjusted in a spacing therebetween.

While primarily guiding both widthwise edges of the separate paper sheet, if it is necessary to mount again the roll type paper P on the paper holding device, by grasping and pushing upward the grasping portion 103 of the lever hook 100, the fixing key portion 103 of the lever hook 100 is removed from the corresponding one of the spacing adjustment perforations 66, and at the same time, the engagement piece 102 is engaged with the engagement projection 21-3 to be supported thereby. Due to returning force of the tension springs S which are connected to the left and right guide links 30 and 40 and the bottom panel 60, the left and right holders 10 and 20 are returned to their original position along the pair of guide slots 61 and 62 of the bottom panel 60 via the left and right guide links 30 and 40.

As best shown in FIGS. 7 and 8, in the second embodiment of the present invention, the elastic member S comprises a torsion spring which is installed between the rotation link 90 and the bottom panel 60. Thus, by elastic force of the torsion spring, the rotation link 90, left and right guide links 30 and 40, and left and right holders 10 and 20 can be properly actuated.

As apparent from the above description, the paper holding device according to the present invention provides advantages in that, since it employs not the conventional gear mechanism but a novel rotation link, inward and outward movement of left and right holders for mounting a paper roll, toward or away from each other, can be easily and quickly implemented. Also, when it is necessary to fix the left and right holders thereby to primarily guide both widthwise edges of a separate paper sheet which is manually fed forward from a rear end of a printer body, through simple manipulation of a lever hook installed on one of the left and right holders, the lever hook can be inserted into a bottom panel to fixedly hold the corresponding holder with respect to the bottom panel, whereby a separate paper sheet guiding procedure can be easily and quickly conducted when compared to the conventional art in which a fastening screw must be laboriously driven into or removed from a threaded hole using a driver.

Further, in the present invention, upon holding, on the printer body, the paper roll of a predetermined size, since the left and right holders for supporting both ends of the paper roll can be easily and quickly moved toward or away from each other due to the presence of the rotation link, a paper roll mounting procedure can be conveniently conducted. Therefore, when compared to the conventional art employing the fastening screw to fix the holder, in the present invention, because the lever hook is installed on the corresponding holder, the possibility of the lever hook to be lost is eliminated, and a holder fixing or freeing work can be conveniently executed.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A paper holding device for a label printer, comprising:

left and right holders for supporting both ends, respectively, of a paper roll;

left and right guide links respectively locked to lower ends of the left and right holders;

a rotation link for operatively connecting the left and right guide links with each other and moving them in leftward and rightward directions;

wherein the rotation link is defined with a pair of elongate holes for guiding pin portions of the left and right guide links, and, between the pair of elongate holes, with an insertion hole;

a bottom panel secured with respect to a floor of a printer body, for rotatably installing thereon the rotation link; and a pair of elastic members each having one end connected to the left and right guide links and the other end connected to the bottom panel, to apply elastic force to the left and right guide links.

2. The paper holding device as set forth in claim 1, wherein the left and right holders respectively comprise:

circular protrusions formed at upper ends of the left and right holders to be inserted into both ends of a center hole of the paper roll thereby to support the paper roll;

grips projectedly formed adjacent to the lower ends of the left and right holders;

bases formed at the lower ends of the left and right holders, each provided at front and rear ends thereof with a pair of leg portions, and defined, on lower surfaces of the leg portions, with grooves and, through the rear leg portion of the left base and the front leg portion of right base, with two pairs of first locking holes which extend in a vertical direction and are communicated with the grooves;

vertical guide grooves defined on surfaces of the left and right holders, which surfaces are opposite to the circular protrusions;

stepped portions formed at a predetermined location on the surfaces of the left and right holders, defining the vertical guide grooves; and engagement projections formed below the stepped portions on the surfaces of the left and right holders, defining the vertical guide grooves.

3. The paper holding device as set forth in claim 2, wherein the left and right guide links respectively comprise:

guide projections received in the grooves of the left and right holders, and defined with two pairs of second locking holes which are respectively aligned with the two pairs of first locking holes;

guide plates secured to the guide projections;

hook pieces fastened to respective rear and front surfaces of the guide plates; and the pin portions projectedly formed on lower surfaces of the guide plates in a manner such that they are opposite to the guide projections.

4. The paper holding device as set forth in claim 1, wherein the bottom panel comprises:

a pair of guide slots for guiding leftward and rightward movement of the left and right guide links;

a shaft portion projectedly formed on a lower surface of the bottom panel between the pair of guide slots to be rotatably fitted into the insertion hole of the rotation link; and a plurality of spacing adjustment perforations defined through the bottom panel adjacent to the pair of guide slots.

5. The paper holding device as set forth in claim 1, further comprising:

a lever hook installed on a selected one of the left and right holders to adjust a spacing between the left and right holders.

6. The paper holding device as set forth in claim 5, wherein the lever hook comprises:

an elongate fixing key portion formed at a lower end of the lever hook;

an engagement piece secured adjacent to the lower end of the lever hook and defined with at least two engaging grooves in which the engagement projection of the corresponding holder is engaged in a stepwise manner; and a grasping portion integrally formed at an upper end of the lever hook in a manner such that it can be rested on the stepped portion of the corresponding holder.

7. The paper holding device as set forth in claim 1, wherein the at least one elastic member comprises a coiled tension spring.

8. A paper holding device for a label printer, comprising:

left and right holders for supporting both ends, respectively, of a paper roll;

left and right guide links respectively locked to lower ends of the left and right holders;

a rotation link for operatively connecting the left and right guide links with each other and moving them in leftward and rightward directions;

a bottom panel secured with respect to a floor of a printer body, for rotatably installing thereon the rotation link which functions to guide leftward and rightward movement of the left and right guide links; and an elastic member connected to the rotation link to apply elastic force to the rotation link as the rotation link is rotated.

9. The paper holding device as set forth in claim 8, wherein the left and right holders respectively comprise:

circular protrusions formed at upper ends of the left and right holders to be inserted into both ends of a center hole of the paper roll thereby to support the paper roll;

grips projectedly formed adjacent to the lower ends of the left and right holders;

bases formed at the lower ends of the left and right holders, each provided at front and rears ends thereof with a pair of leg portions, and defined, on lower surfaces of the leg portions, with grooves and, through the rear leg portion of the left base and the front leg portion of right base, with two pairs of first locking holes which extend in a vertical direction and are communicated with the grooves;

vertical guide grooves defined on surfaces of the left and right holders, which surfaces are opposite to the circular protrusions;

stepped portions formed at a predetermined location on the surfaces of the left and right holders, defining the vertical guide grooves; and engagement projections formed below the stepped portions on the surfaces of the left and right holders, defining the vertical guide grooves.

10. The paper holding device as set forth in claim 9, wherein the left and right guide links respectively comprise:

guide projections received in the grooves of the left and right holders, and defined with two pairs of second locking holes which are respectively aligned with the two pairs of first locking holes;

guide plates secured to the guide projections; and pin portions projectedly formed on lower surfaces of the guide plates in a manner such that they are opposite to the guide projections.

11. The paper holding device as set forth in claim 10, wherein the rotation link is defined with a pair of elongate holes for guiding the pin portions of the left and right guide links, and, between the pair of elongate holes, with an insertion hole.

12. The paper holding device as set forth in claim 8, wherein the bottom panel comprises:

a pair of guide slots for guiding leftward and rightward movement of the left and right guide links;

a shaft portion projectedly formed on a lower surface of the bottom panel between the pair of guide slots to be rotatably fitted into the insertion hole of the rotation link; and a plurality of spacing adjustment perforations defined through the bottom panel adjacent to the pair of guide slots.

13. The paper holding device as set forth in claim 8, further comprising:

a lever hook installed on a selected one of the left and right holders to adjust a spacing between the left and right holders.

14. The paper holding device as set forth in claim 13, wherein the lever hook comprises:

an elongate fixing key portion formed at a lower end of the lever hook;

an engagement piece secured adjacent to the lower end of the lever hook and defined with at least two engaging grooves in which the engagement projection of the corresponding holder is engaged in a stepwise manner; and a grasping portion integrally formed at an upper end of the lever hook in a manner such that it can be rested on the stepped portion of the corresponding holder.

15. The paper holding device as set forth in claim 8, wherein the elastic member comprises a torsion spring.

16. The paper holding device as set forth in claim 8, wherein the elastic member is arranged between the bottom panel and the rotation link.

17. The paper holding device as set forth in claim 8, wherein the elastic member is arranged between a lower surface of the rotation link and the floor of the printer body.

* * * * *